US008678838B2

(12) United States Patent
Kim et al.

(10) Patent No.: US 8,678,838 B2
(45) Date of Patent: Mar. 25, 2014

(54) SOCKET AND DISPLAY APPARATUS HAVING THE SAME

(75) Inventors: Jae-Kyoung Kim, Yongin (KR); Bong-Kyoon Sun, Yongin (KR); Jong-Seok Chae, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 551 days.

(21) Appl. No.: 13/028,135

(22) Filed: Feb. 15, 2011

(65) Prior Publication Data

US 2012/0127135 A1 May 24, 2012

(30) Foreign Application Priority Data

Nov. 22, 2010 (KR) ..... 10-2010-0116206

(51) Int. Cl.
*H01R 12/00* (2006.01)

(52) U.S. Cl.
USPC ..... 439/74; 439/61

(58) Field of Classification Search
USPC ..... 439/61, 74
See application file for complete search history.

(56) References Cited

U.S. PATENT DOCUMENTS

| | | | | |
|---|---|---|---|---|
| 3,132,913 | A * | 5/1964 | Pohl | 439/402 |
| 3,340,440 | A * | 9/1967 | Minter | 439/82 |
| 3,778,753 | A * | 12/1973 | Occhipinti et al. | 439/631 |
| 4,028,794 | A * | 6/1977 | Ritchie et al. | 29/882 |
| 4,029,374 | A * | 6/1977 | Nestor et al. | 439/74 |
| 4,061,405 | A * | 12/1977 | Minter | 439/83 |
| 4,521,065 | A * | 6/1985 | Nestor et al. | 439/61 |
| 5,788,510 | A * | 8/1998 | Walker | 439/61 |
| 7,828,559 | B2 * | 11/2010 | Chen et al. | 439/74 |
| 2007/0141866 | A1 * | 6/2007 | Kishi et al. | 439/74 |
| 2009/0029572 | A1 * | 1/2009 | Midorikawa | 439/74 |
| 2010/0291776 | A1 * | 11/2010 | Huang et al. | 439/74 |
| 2012/0127135 | A1 * | 5/2012 | Kim et al. | 345/204 |

FOREIGN PATENT DOCUMENTS

| | | |
|---|---|---|
| JP | 2009-230988 | 10/2009 |
| KR | 10-2002-0025972 A | 4/2002 |
| KR | 10-2007-0064285 A | 6/2007 |
| KR | 10-2007-0064286 A | 6/2007 |

* cited by examiner

*Primary Examiner* — James Harvey
(74) *Attorney, Agent, or Firm* — Christie, Parker & Hale, LLP

(57) ABSTRACT

A socket includes a conductive base, a first socket terminal, and a second socket terminal, the first socket terminal extends from one end of the base, and the second socket terminal extends from an other end of the base, opposite to the first socket terminal with the base therebetween. Further, the first socket terminal has a first contact portion extending from the base and contacting with a terminal of the connector, a second contact portion extending from the first contact portion and contacting with the terminal of the connector, and a first bending portion extending from the second contact portion and bending away from the first contact portion.

10 Claims, 2 Drawing Sheets

SOCKET AND DISPLAY APPARATUS HAVING THE SAME

CROSS-REFERENCE TO RELATED APPLICATION

This application claims priority to and the benefit of Korean Patent Application No. 10-2010-0116206, filed on Nov. 22, 2010, in the Korean Intellectual Property Office, the entire content of which is incorporated herein by reference.

BACKGROUND

1. Field

The following description relates to a socket and a display apparatus having the socket, in more detail a socket that can be stably coupled to a connector and a display device having the socket.

2. Description of Related Art

In general, display apparatuses include a display panel that displays an image and a driver that receives power from the outside and provides a driving signal corresponding to the image to the display panel. Further, the driver may have a socket that is coupled to a connector to receive a power from the connector.

Meanwhile, the fastening force between the socket and the connector may be reduced by deformation of the outer shape of the terminal of the socket due to repetition of coupling and uncoupling between the socket and the connector. Therefore, it is desired to implement a structure to stably couple the socket to the connector, even when the socket and the connector are repeatedly coupled and uncoupled.

SUMMARY

An aspect of an embodiment of the present invention is directed toward a socket that can be stably coupled to a connector, and a display apparatus having the socket.

An embodiment of the present invention provides a socket that is electrically connected with a connector. The socket includes a conductive base, a first socket terminal, and a second socket terminal. The first socket terminal extends from one end of the base and the second socket terminal extends from an other end of the base, opposite to the first socket terminal with the base therebetween.

In this embodiment, the first socket terminal has a first contact portion extending from the base and contacting with a terminal of the connector, a second contact portion extending from the first contact portion and contacting with the terminal of the connector, and a first bending portion extending from the second contact portion and bending away from the first contact portion.

In an other embodiment, a display apparatus includes a display panel that displays an image and a driver that receives an external power through a socket coupled to a connector and provides a driving signal corresponding to the image to the display panel.

In this other embodiment, the socket includes a conductive base, a first socket terminal, and a second socket terminal. The first socket terminal extends from one end of the base and the second socket terminal extends from an other end of the base, opposite to the first socket terminal with the base therebetween.

Further, the first socket terminal has a first contact portion extending from the base and contacting with a terminal of the connector, a second contact portion extending from the first contact portion and contacting with the terminal of the connector, and a first bending portion extending from the second contact portion and bending away from the first contact portion.

According to the structure of the socket of an embodiment of the present invention, the outer shape of the socket terminal is not deformed, even when the socket is separated from the connector by pulling the portion spaced apart from the center of the connector, such that the socket can be stably coupled to the connector.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
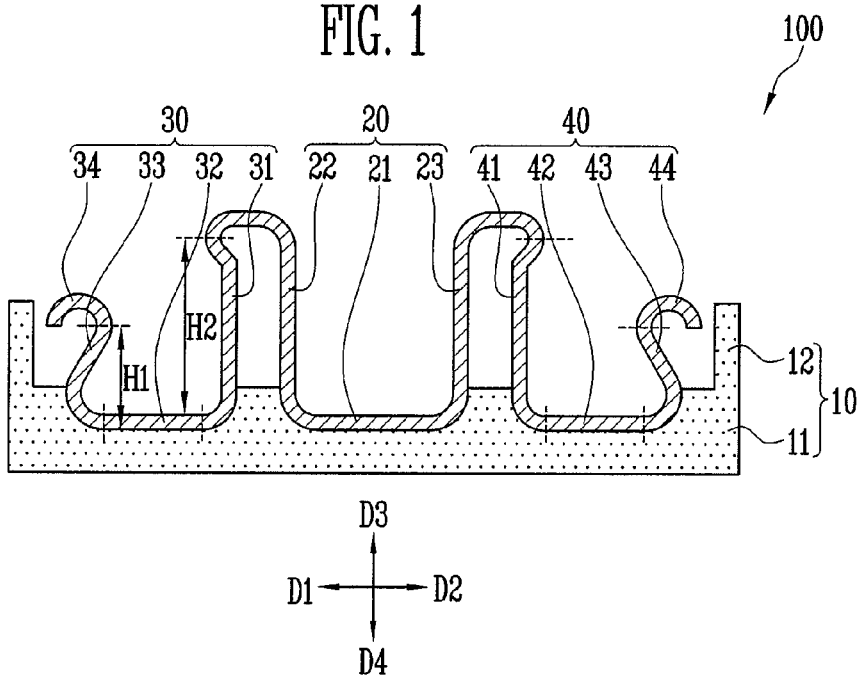
FIG. 1 is a cross-sectional view of a socket according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" an other element, it can be directly on the other element or be indirectly on the other element with one or more intervening elements interposed therebetween. Also, when an element is referred to as being "connected to" an other element, it can be directly connected to the other element or be indirectly connected to the other element with one or more intervening elements interposed therebetween. Hereinafter, like reference numerals refer to like elements.

Hereinafter, embodiments of the present invention will be described in detail with reference to the accompanying drawings. The objects, features, and effects of the present invention will be easily understood from the embodiments relating to the accompanying drawings. However, the present invention is not limited to the embodiments described herein and may be modified in various ways. For example, the following embodiments are provided to make the scope of the invention clear and also sufficiently provide the scope of the present invention to those skilled in the art. Therefore, claims of the present invention should not be construed as being limited to the following embodiments. Meanwhile, the drawings provided in connection with the following embodiments are relatively simplified or exaggerated for clear description and like reference numerals in the drawings designate like components.

FIG. 1 is a cross-sectional view of a socket according to an embodiment of the present invention.

Referring to FIG. 1, a socket 100 includes a mold 10, a base 20, a first socket terminal 30, and a second socket terminal 40.

The mold 10 includes an insulator, such as plastic; and the mold 10 has a bottom 11 and sides 12 extending from the bottom 11, accommodating the base 20, the first socket terminal 30, and the second socket terminal 40.

The first socket terminal 30 extends from one end of the base 20, and the second socket terminal 40 extends from the other end of the base 20. In the embodiment of the present invention shown in FIG. 1, the base 20, the first socket terminal 30, and the second socket terminal 40 may be integrally formed (e.g., as one body). The detailed structures of the base 20, the first socket terminal 30, and the second socket terminal 40 are as follows.

The base 20 is made of metal to be conductive, and is positioned between the first socket terminal 30 and the second socket terminal 40, and is connected with the first socket terminal 30 and the second socket terminal 40. In the embodiment shown in FIG. 1, the base 20 may have a U-shaped cross-section.

In more detail, the base 20 has a first base coupling portion 21 that extends in a first direction D1 or a second direction D2 and coupled with the mold 10, a first connecting portion 22 that extends from one end of the base coupling portion 21 in a third direction D3 perpendicular to the first and second directions D1 and D2, and a second connecting portion 23 that extends from the other end of the base coupling portion 21 in the third direction D3.

The first socket terminal 30 is connected with the first connecting portion 22. The first socket terminal 30 of the socket 100 is a portion that is electrically connected with an external terminal provided from the outside, and for example, the first socket terminal 30 may be electrically connected with a first connector terminal 130 (see FIG. 2) of a connector 200 (see FIG. 2). In the embodiment shown in FIG. 1, the detailed structure of the first socket terminal 30 is as follows.

The first socket terminal 30 has a first contact portion 31, a first terminal coupling portion 32, a second contact portion 33, and a first bending portion 34. The first contact portion 31 extends from one end of the first connecting portion 22 in a fourth direction D4. In the first socket terminal 30, the first contact portion 31 is a portion that contacts with the external terminal, and for example, the first contact portion 31 may contact with the first connector terminal 130 (see FIG. 2).

The first terminal coupling portion 32 extends from one end of the first contact portion 31 in the first direction D1 or the second direction D2. In the embodiment shown in FIG. 1, the first terminal coupling portion 32 may be coupled with the bottom 11 of the mold 10, such that the first socket terminal 30 may be fixed to the mold 10, and the first terminal coupling portion 32 may contact with the external terminal in accordance with the insertion degree of the external terminal in the first socket terminal 30.

The second contact portion 33 extends from one end of the first terminal coupling portion 32 and bends toward the first contact portion 31, opposite to the first contact portion 31. Similar to the first contact portion 31, the second contact portion 33 is a portion that contacts with an external terminal provided from the outside, in the first socket terminal 30, and for example, the second contact portion 33 may contact the first connector terminal 130 together with the first contact portion 31 (see FIG. 2).

Meanwhile, as described above, the first terminal coupling portion 32 between the first contact portion 31 and the second contact portion 33 is fixed to the bottom 11, and the first contact portion 31, the first terminal coupling portion 32, and the second contact portion 33 are integrally formed (e.g., as one body). Therefore, when the external terminal provided from the outside is inserted in between the first contact portion 31 and the second contact portion 33, the second contact portion 33 has enough elasticity (or the elasticity) to return after moving away from the first contact portion 31. That is, the first contact portion 31 and the second contact portion 33 can clamp the external terminal by using the elasticity of the second contact portion 33 together with the first terminal coupling portion 32 and the first contact portion 31.

The first bending portion 34 extends from one end of the second contact portion 33 and bends away from the first contact portion 31. In other words, the second contact portion 33 bends toward the first contact portion 31, whereas the first bending portion 34 bends away from the first contact portion 31. As a result, it is possible to prevent (or protect) the structure of the first socket terminal 30 from being deformed by load concentration on a portion of the first socket terminal 30, when the external terminal (that has been inserted in between the first contact portion 31 and the second contact portion 33) is separated from the first contact portion 31 and the second contact portion 32. This will be described in more detail with reference to FIG. 3.

Meanwhile, in the embodiment shown in FIG. 1, assuming that the distance from the first terminal coupling portion 32 to the uppermost end of the second contact portion 33 is defined as the first height H1, and the distance from the first terminal coupling portion 32 to the uppermost end of the first contact portion 31 is defined as the second height H2, the half of the second height H2 may be the same as or larger than the first height H1. Further, in this case, the position of the first bending portion 34 extending from the uppermost end of the second contact portion 33 can be defined, and accordingly, the sum of the length of the second contact portion 33 and the length of the first bending portion 34 may be the same as or smaller than the length of the first contact portion 31.

The second socket terminal 40 has a structure that is symmetric to the first socket terminal, with the base 20 therebetween. Therefore, since the second socket terminal 40 has a structure similar to the first socket terminal 30, the structure of the second socket terminal 40 is briefly described.

The second socket terminal 40 has a third contact portion 41, a second terminal coupling portion 42, a fourth contact portion 43, and a second bending portion 44. The third contact portion 41 extends from one end of the second connecting portion 23 in the fourth direction D4. In the second socket terminal 40, the third contact portion 41 is a portion that contacts with the external terminal, and for example, the third contact portion 41 may contact with the second connector terminal 140 (see FIG. 2).

The second terminal coupling portion 42 extends from one end of the third contact portion 41 and is coupled with the bottom 11 of the mold 10. Further, the fourth contact portion 43 extends from one end of the second terminal coupling portion 42 and bends toward the third contact portion 41, opposite to the third contact portion 41. The fourth contact portion 43 is a portion that contacts with the external terminal provided from the outside, and for example, the fourth contact portion 43 may contact with the second connector terminal 140 (see FIG. 2) together with the third contact portion 41.

Meanwhile, similar to the structures of the first and second contact portions 31 and 33, which have been described above, the third and the fourth contact portions 41 and 43 can clamp the external terminal provided from the outside by using the elasticity of the fourth contact portion 43 together with the second terminal coupling potion 42 and the third contact portion 41.

The second bending portion 44 extends from one end of the fourth contact portion 43 and bends away from the third contact portion 41. As a result, it is possible to prevent (or protect) the structure of the second socket terminal 40 from being deformed by load concentration on a portion of the second socket terminal 40, when the external terminal (that has been inserted in between the third contact portion 41 and the fourth contact portion 43) is separated from the third contact portion 41 and the fourth contact portion 43. This will be described in more detail with reference to FIG. 3.

Meanwhile, in the embodiment shown in FIG. 1, similar to the first contact portion 31, the second contact portion 33, and the first bending portion 34, which have been described above, the half of the height from the second terminal coupling portion 42 to the uppermost end of the third contact portion 41 may be the same as or larger than the height from the second terminal coupling portion 42 to the uppermost end of the fourth contact portion 43. Further, in this case, the position of the second bending portion 44 extending from the uppermost end of the fourth contact portion 43 can be defined, and accordingly, the sum of the length of the fourth contact portion 43 and the length of the second bending portion 44 may be the same as or smaller than the length of the third contact portion 41.

Figure 2:
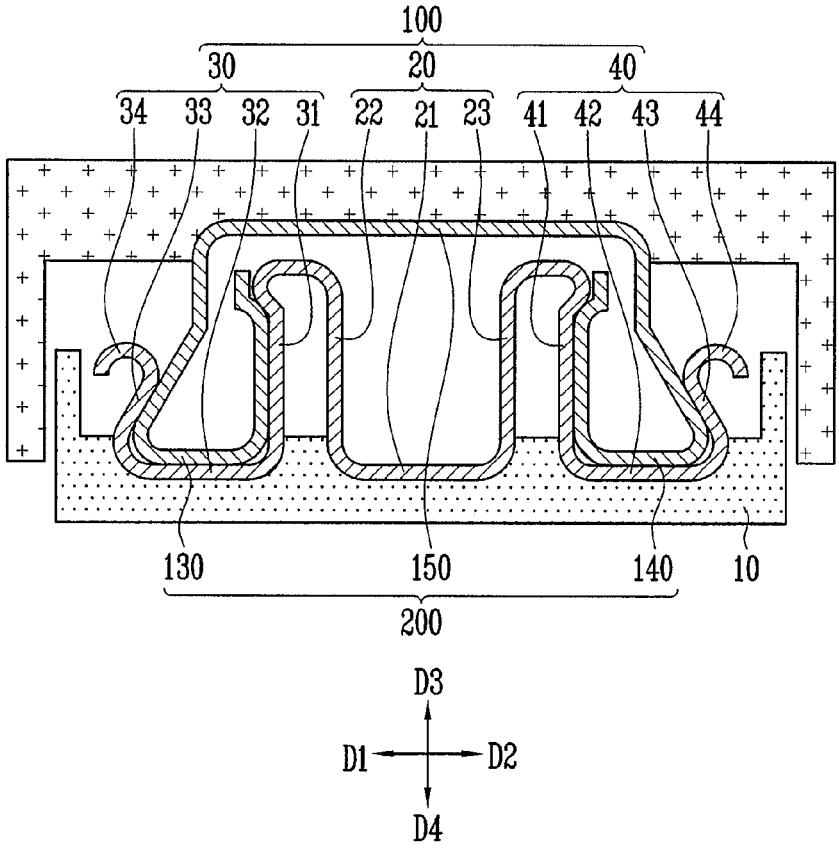
FIG. 2 is a cross-sectional view of the socket shown in FIG. 1 and a connector coupled with the socket.

FIG. 2 is a cross-sectional view of the socket shown in FIG. 1 and a connector coupled with the socket. Meanwhile, the socket 100 that has been described with reference to FIG. 1 is shown in FIG. 2. Therefore, in the description of FIG. 2, repeated description for the structure of the socket 100 that has been described above with reference to FIG. 1 is not provided.

Referring to FIG. 2, the socket 100 is coupled with the connector 200. The connector 200 has the first connector terminal 130, the second connector terminal 140, and the terminal connecting portion 150.

The terminal connecting portion 150 is positioned between the first connector terminal 130 and the second connector terminal 140 and connects the first and second connector terminals 130 and 140. Further, the first connector terminal 130 and the second connector terminal 140 are coupled with the first socket terminal 30 and the second socket terminal 40, respectively.

The first connector terminal 130 extends from one end of the terminal connecting portion 150, and the second connector terminal 140 extends from the other end of the terminal connecting portion 150. The first connector terminal 130 and the second connector terminal 140 may be made of conductive materials, such as metal.

The first connector terminal 130 bends to correspond to the bending shapes of the first terminal coupling portion 32 and the first and second contact portions 31 and 33, and is configured to contact the first terminal coupling portion 32 and the first and second contact portions 31 and 33. Similar to the first connector terminal 130, the second connector terminal bends to correspond to the bending shapes of the second terminal coupling portion 42 and the third and fourth contact portions 41 and 43, and is configured to contact the second terminal coupling portion 42 and the third and fourth contact portions 41 and 43.

Meanwhile, it is preferable to pull (or apply a force at) the center portion of the connector 200 such that force does not concentrate on the first connector terminal 130 nor the second connector terminal 140, when separating the connector 200 from the socket 100. However, it may be difficult to always pull (or apply the force at) the center portion of the connector during repetitions of coupling and uncoupling of the socket 100 and the connector 200. Therefore, even if force concentrates on any one of the first connector terminal 130 and the second connector terminal 140, when the connector 200 is separated from the socket 100, it is desired that the socket terminal coupled with the connector where the force concentrates on has a structure of which the outer shape does not deform.

The outer shapes of the first socket terminal 30 and the second socket terminal 40 are prevented (or protect) from deformation, when the connector 200 is separated from the socket 100, because the socket 100 according to an embodiment of the present invention has the first bending portion 34 and the second bending portion 44. This is described in more detail with reference to FIG. 3.

Figure 3:
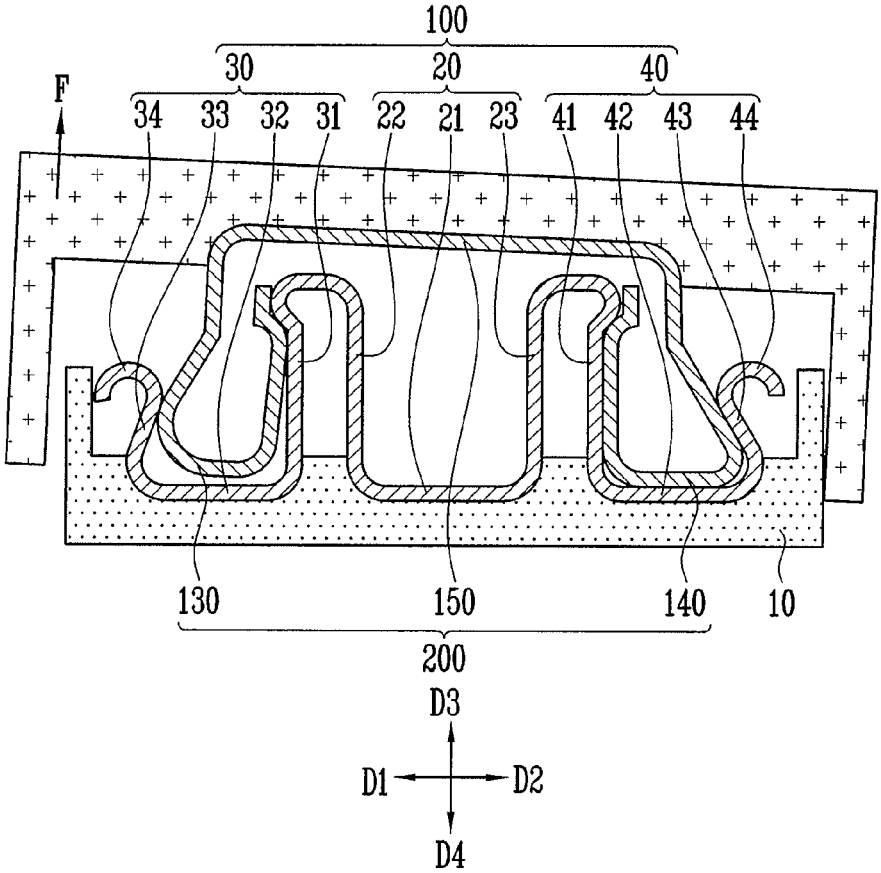
FIG. 3 is a cross-sectional view showing when the socket and the connector shown in FIG. 2 are uncoupled.

FIG. 3 is a cross-sectional view showing when the socket and the connector shown in FIG. 2 are being uncoupled.

Referring to FIG. 3, it is assumed that force F is applied to the connector 200, such that the connector 200 is separated from the socket 100, and the force F is not exerted in the center portion of the connector, but concentrates on a portion adjacent to the first connector terminal 130 of the connector 200 and is exerted in the connector 200.

As the force F is applied to the connector 200, the first connector terminal 130 is separated from the first socket terminal 30, with the second connector terminal 140 still coupled to the second socket terminal 40. As described above with reference to FIG. 1, since the first contact portion 31 and the second contact portion 33 clamp the first connector terminal 130, when the first connector terminal 130 is separated from the first socket terminal 30, the second contact portion 33 moves in the first direction D1, such that the gap between the first contact portion 31 and the second contact portion 33 increases, and accordingly, the first connector terminal 130 is separated from the first socket terminal 30.

If the first socket terminal 30 does not have the first bending portion 34, the end of the second contact portion 33 bends only toward the first contact portion 31, such that the fastening force between the first and second contact portions 31 and 33 and the first connector terminal 130 can be increased. However, when the first connector terminal 130 is separated from the first socket terminal 30 by the force F, the first and second contact portions 31 and 33 function as lockers that prevent (or protect) the first connector terminal 130 from being separated from the first socket terminal 30. Therefore, while the first connector terminal 130 is separated from the first socket terminal 30, the force F is excessively exerted in the first socket terminal 30, and the outer shape of the first socket terminal 30 may be deformed.

However, as described with reference to FIG. 1, the first socket terminal 30 has the first bending portion 34 that bends away from the first contact portion 31, extending from the second contact portion 33. Therefore, the first connector terminal 130 can be easily separated from the first socket terminal 30, along the second contact portion 33 together with the first bending portion 34, such that the force F is prevented (or protected) from being excessively exerted in (or on) the first socket terminal 30 and the first connector terminal 130 can be easily separated from between the first and second contact portions 31 and 33, with the outer shape of the first socket terminal 30 not deformed.

Figure 4:
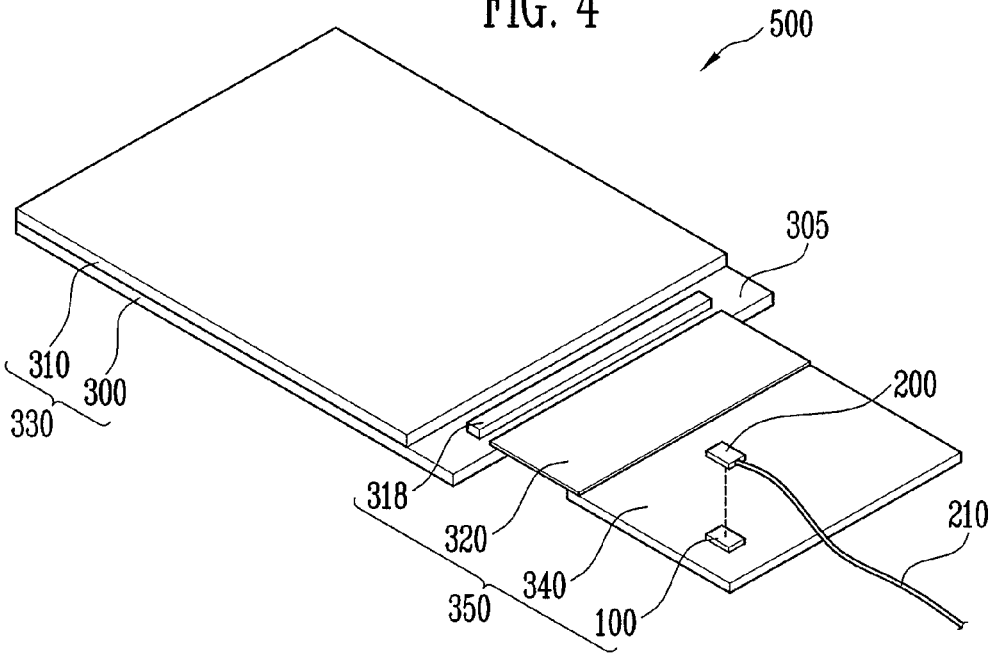
FIG. 4 is a perspective view of a display apparatus according to an other embodiment of the present invention.

FIG. 4 is a perspective view of a display apparatus according to an other embodiment of the present invention. Here, a display apparatus shown in FIG. 4 includes the socket 100, which has been described above with reference to FIGS. 1 to 3, as a component. Therefore, in the description of FIG. 4, the components described above are designated by the same reference numerals and the detailed description for the components is not provided.

Referring to FIG. 4, a display apparatus 500 includes a display panel 330 and a driver 350.

The display panel 330 displays an image, and the display panel 330 includes a first substrate 300 and a second substrate 310 facing (opposite to) the first substrate 300. In the embodiment shown in FIG. 4, the display panel 330 may be a liquid display panel or an organic light emitting display panel. When the display panel 330 is a liquid crystal display panel, the display panel 300 may include a pixel electrode and a pixel that has a thin film transistor which is electrically connected with the pixel electrode and switches a driving signal that is supplied to the pixel electrode. Further, when the display pane 330 is an organic light emitting display panel, the display panel 300 may include a pixel having an anode electrode, a thin film transistor which switches a driving signal that is supplied to the anode electrode, an organic light emitting layer on the anode electrode, and a cathode electrode on the organic light emitting layer.

The driver 350 includes a printed circuit board 340 having the socket 100, a flexible printed circuit 320, and a driving chip 318.

The printed circuit board 340 has the socket 100 and the socket 100 is coupled to the connector 200 connected with a power line 210 led from the output terminal of an external power supply. Therefore, the power outputted from the external power supply can be supplied to the printed circuit board 340 through the socket 100 that is coupled to the connector 200, and the printed circuit board 340 generates a source signal by receiving the power through the socket 100.

According to the structure of the driver 350, which has been described above with reference to FIGS. 1 to 3, the outer shapes of the first and second socket terminals 30 and 40 (see FIG. 1) of the socket 100 are prevented (or protect) from deforming, even if coupling and uncoupling of the socket 100 and the connector 200 are repeated. Therefore, the connector 200 can be more stably coupled to the socket 100.

One end of the flexible printed circuit 320 is bonded to a bonding region 305 of the first substrate 300, and the other end of the flexible printed circuit 320 is bonded to the output end of the printed circuit board 340. Therefore, the source signal can be supplied to the first substrate 300 through the flexible printed circuit 320, and the driving chip 318 is disposed in the bonding region 305 and outputs a driving signal for activating the pixel to the pixel in response to the source signal.

Meanwhile, in the embodiment shown in FIG. 4, the socket 100 that has been described with reference to FIGS. 1 to 3 is disposed on the printed circuit board 340. However, the socket 100 may be disposed on an other component that receives a signal from the connector 200 and stably coupled to the connector 200, as well as the printed circuit board 340.

In view of the foregoing and according to the structure of the socket of an embodiment of the present invention, the outer shape of the first socket terminal is not deformed, even when the socket is separated from the connector by pulling the portion spaced apart from the center of the connector, such that the socket can be stably coupled to the connector.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A socket configured to be electrically connected with a connector, the socket comprising:

a base having conductivity;

a first socket terminal having conductivity and extending from one end of the base; and a second socket terminal having conductivity and extending from an other end of the base, opposite to the first socket terminal with the base therebetween, wherein the first socket has:

a first contact portion extending from the base and for contacting with a terminal of the connector;

a second contact portion extending from the first contact portion and for contacting with the terminal of the connector; and a first bending portion extending from the second contact portion and bending away from the first contact portion, wherein a half of a height from a lower end to an upper end of the first contact portion is the same as or larger than a height from a lower end to an upper end of the second contact portion.

2. The socket according to claim 1, wherein the second socket terminal has:

a third contact portion extending from the base and for contacting with an other terminal of the connector;

a fourth contact portion extending from the third contact portion and for contacting with the other terminal of the connector; and a second bending portion extending from the fourth contact portion and bending away from the fourth contact portion.

3. The socket according to claim 2, wherein the second contact portion is configured to clamp the terminal of the connector together with the first contact portion by bending toward the first contact portion, and the fourth contact portion is configured to clamp the other terminal of the connector together with the third contact portion by bending toward the third contact portion.

4. The socket according to claim 3, wherein a half of a height from a lower end to an upper end of the third contact portion is the same as or larger than a height from a lower end to an upper end of the fourth contact portion.

5. The socket according to claim 2, wherein a sum of a length of the second contact portion and a length of the first bending portion is the same as or smaller than a length of the first contact portion, and a sum of a length of the fourth contact portion and a length of the second bending portion is the same as or smaller than a length of the third contact portion.

6. A display apparatus comprising:

a display panel for displaying an image; and a driver for receiving an external power through a socket coupled to a connector and for supplying a driving signal corresponding to the image to the display panel, wherein the socket comprises:

a base having conductivity;

a first socket terminal having conductivity and extending from one end of the base; and a second socket terminal having conductivity and extending from an other end of the base, opposite to the first socket terminal with the base therebetween, and the first socket has:

a first contact portion extending from the base and for contacting with a terminal of the connector;

a second contact portion extending from the first contact portion and for contacting with the terminal of the connector; and a first bending portion extending from the second contact portion and bending away from the first contact portion, wherein a half of a height from a lower end to an upper end of the first contact portion is the same as or larger than a height from a lower end to an upper end of the second contact portion.

7. The display apparatus according to claim 6, wherein the second socket terminal has:

a third contact portion extending from the base and for contacting with an other terminal of the connector;

a fourth contact portion extending from the third contact portion and for contacting with the other terminal of the connector; and a second bending portion extending from the fourth contact portion and bending away from the fourth contact portion.

8. The display apparatus according to claim 7, wherein the second contact portion is configured to clamp the terminal of the connector together with the first contact portion by bending toward the first contact portion, and the fourth contact portion is configured to clamp the other terminal of the connector together with the third contact portion by bending toward the third contact portion.

9. The display apparatus according to claim 8, wherein a half of a height from a lower end to an upper end of the third contact portion is the same as or larger than a height from a lower end to an upper end of the fourth contact portion.

10. The display apparatus according to claim 7, wherein a sum of a length of the second contact portion and a length of the first bending portion is the same as or smaller than a length of the first contact portion, and a sum of a length of the fourth contact portion and a length of the second bending portion is the same as or smaller than a length of the third contact portion.

* * * * *